US008978520B2

(12) United States Patent
Yoshimachi et al.

(10) Patent No.: US 8,978,520 B2
(45) Date of Patent: Mar. 17, 2015

(54) TIGHTENING MACHINE HAVING SOCKET UNIT

(75) Inventors: Akihiro Yoshimachi, Kashiwara (JP); Yukio Torigai, Sakai (JP)

(73) Assignee: Maeda Metal Industries, Ltd., Osaka (JP)

( * ) Notice: Subject to any disclaimer, the term of this patent is extended or adjusted under 35 U.S.C. 154(b) by 339 days.

(21) Appl. No.: 13/316,790

(22) Filed: Dec. 12, 2011

(65) Prior Publication Data

US 2012/0152067 A1 Jun. 21, 2012

(30) Foreign Application Priority Data

Dec. 15, 2010 (JP) ..... 2010-279170

(51) Int. Cl.
*B25B 13/06* (2006.01)
*B25B 23/00* (2006.01)

(52) U.S. Cl.
CPC ..... *B25B 13/06* (2013.01); *B25B 23/0085* (2013.01)
USPC ..... 81/57.36

(58) Field of Classification Search
CPC .... B25B 13/488; B25B 21/002; B25B 23/06; B25B 31/00; B25B 23/0085; B25B 23/105; B23P 19/06; B23P 19/069; B23P 19/067; B23P 19/006; B23P 19/12; F16B 35/045
USPC ..... 81/57.36, 55, 56, 124.5, 57.3, 57.31
See application file for complete search history.

(56) References Cited

U.S. PATENT DOCUMENTS

| | | | | | |
|---|---|---|---|---|---|
| 3,331,268 | A * | 7/1967 | Jones et al. | 81/55 |
| 4,403,529 | A * | 9/1983 | Ikeda et al. | 81/56 |
| 4,472,985 | A * | 9/1984 | Orikasa | 81/56 |
| 4,945,789 | A * | 8/1990 | Martinengo | 81/55 |
| 5,108,238 | A * | 4/1992 | Ewing | 81/55 |
| 5,460,062 | A * | 10/1995 | Wilson, Jr. | 81/56 |
| 5,609,079 | A * | 3/1997 | Hashimoto | 81/177.75 |
| 2005/0034568 | A1 | 2/2005 | Junkers | |
| 2005/0034569 | A1 * | 2/2005 | Junkers | 81/121.1 |
| 2006/0005637 | A1 | 1/2006 | Hirai et al. | |
| 2009/0049959 | A1 | 2/2009 | Gibbs | |

FOREIGN PATENT DOCUMENTS

| | | | |
|---|---|---|---|
| CN | 2902585 | Y | 5/2007 |
| CN | 2902595 | Y | 5/2007 |
| CN | 201077043 | Y | 6/2008 |
| CN | 101648372 | A | 2/2010 |
| DE | 202006006077 | U1 | 8/2006 |

(Continued)

*Primary Examiner* — Hadi Shakeri
(74) *Attorney, Agent, or Firm* — K&L Gates LLP

(57) ABSTRACT

A tightening machine has a socket unit which tightens a reaction washer and a nut to each other. The socket unit includes an inner socket whose tip end can engage with the nut, and an outer socket formed concentrically with the inner socket. A tip end of the outer socket can engage with the reaction washer. The socket unit concentrically includes an inner socket holder and an outer socket holder. The inner socket holder and the outer socket holder can rotate in opposite directions from each other, and the outer socket holder is formed around an outer periphery of the inner socket holder. The inner socket is detachably engaged with the inner socket holder, and the outer socket is detachably engaged with the outer socket holder. The inner socket is engaged with the inner socket holder with clearance in its circumferential direction.

2 Claims, 6 Drawing Sheets

(56) References Cited

FOREIGN PATENT DOCUMENTS

| | | | |
|---|---|---|---|
| EP | 1506842 | A1 | 2/2005 |
| EP | 1683607 | A1 | 7/2006 |
| JP | 50-140094 | U | 11/1975 |
| JP | 63-278768 | A | 11/1988 |
| JP | 64-34677 | A | 2/1989 |
| JP | 2005-59202 | A | 3/2005 |
| JP | 2008-36727 | A | 2/2008 |

* cited by examiner

TIGHTENING MACHINE HAVING SOCKET UNIT

CROSS REFERENCE TO RELATED APPLICATION

This application claims the benefit of Japanese Patent Application No. 2010-279170 filed on Dec. 15, 2010, entitled "TIGHTENING MACHINE HAVING SOCKET UNIT", which is hereby incorporated by reference herein.

BACKGROUND OF THE INVENTION

1. Field of the Invention

The present invention relates to a socket unit used for tightening a nut while interposing a reaction washer therebetween and to a tightening machine having the socket unit, and more particularly, the present invention relates to a tightening machine having a socket unit, even in a phase misalignment between a nut and a reaction washer, capable of easily fitting an outer socket to a reaction washer in a state where a nut is fitted to an inner socket.

2. Description of Related Art

As shown in FIG. 15, there is a known method in which when structures are to be tightened to each other, a reaction washer 95 is fitted around a bolt 91 projecting from the structure 90, and a nut 93 is tightened from above the reaction washer 95. The reaction washer 95 has a concavo-convex periphery 96 in which twelve V-shaped grooves are repeatedly formed in a peripheral surface of a disk-like washer at about 30° intervals, and the nut 93 is tightened using a tightening machine provided at its tip end with a socket unit while receiving a tightening reaction force by the reaction washer 95.

The tightening machine is concentrically provided with an inner socket holder and an outer socket holder which rotate in opposite directions from each other. The socket unit includes an inner socket and an outer socket which are formed concentrically.

The inner socket is provided at its base end outer periphery with a mounting projection. The mounting projection detachably engages with the inner socket holder of the tightening machine. A mounting groove is formed in an inner periphery of the inner socket holder. The inner socket is fitted to a mounting groove formed in an inner periphery of the inner socket holder without clearance in its circumferential direction. The outer socket also detachably engages with the outer socket holder, and if the tightening machine is operated, the inner socket and the outer socket rotate in opposite directions from each other.

The nut 93 is tightened in such a manner that an inner peripheral surface of a tip end of the inner socket is fitted to the nut 93, and then an inner peripheral surface of a tip end of the outer socket is fitted to the reaction washer 95 and in this state, the tightening machine is operated.

It is necessary to tighten the nut 93 under preset torque, but primary tightening (temporarily tightening) is carried out before a so-called final tightening operation for tightening the nut 93 under the set torque. In this primary tightening operation, positions in the rotation direction ("phase", hereinafter) of the reaction washer 95 and the nut 93 align with each other in some cases as shown in FIG. 16A, but the phases of the reaction washer 95 and the nut 93 are misaligned in most of cases as shown in FIG. 16B.

When the nut 93 and the reaction washer 95 are compared with each other, the nut 93 is thicker than the reaction washer 95 as shown in FIG. 15. Therefore, when the socket unit is fitted to the nut 93 and the reaction washer 95, the inner socket is firstly fitted to the nut 93, and then, if the socket unit is further moved forward, the outer socket is fitted to the reaction washer 95.

When the inner socket and the nut 93 are fitted to each other, even if the phases of the inner socket and the nut 93 are misaligned each other, if an operator rotates the tightening machine itself around its axis, the phase misalignment can be solved. Therefore, the inner socket can be fitted to the nut 93.

However, when the reaction washer 95 is to be fitted to the outer socket after the nut 93 is fitted to the inner socket, the outer socket does not excellently mesh with the concavo-convex periphery 96 of the reaction washer 95 depending upon the phase misalignment between the reaction washer 95 and the nut 93, as shown in the above and in FIGS. 16A and 16B, and the outer socket cannot be fitted to the reaction washer 95.

Hence, it is proposed that an inner surface shape of a nut-engaging hole 32 formed in the inner socket to which the nut 93 is fitted is not formed into the same hexagonal shape as that of the nut 93, a width of a bottom surface 33*a* of a groove 33 is widened to about 30° and an inner socket 30 having a nut-engaging hole 32 having clearance is used. Concerning a shape of the groove 33 of the inner socket, see a front view of FIG. 12 of the present invention.

By widening the width of the groove 33, it is possible to provide clearance of about 30° in the case of the illustrated example. Therefore, if a phase misalignment between the reaction washer 95 and the nut 93 is as small as 5° or 10° and is much smaller than 30°, it is theoretically possible to engage the reaction washer 95 with the outer socket if an operator rotates the tightening machine itself around its axis after the nut 93 is made to mesh with the inner socket.

The maximum phase misalignment between the reaction washer and the nut is theoretically 30° but members vary and the nut and the reaction washer are not concentric. Therefore, the maximum phase misalignment between the reaction washer and the nut exceeds 30° in some cases. In such a case, even if the tightening machine itself is rotated, the reaction washer cannot be engaged with the outer socket. Hence, in such a case, a so-called inching operation is required. In the inching operation, the tightening machine is slightly operated to align the phases of the outer socket and the inner socket from each other. If the phases do not align by one inching operation, the inching operation must be repeated many times and this deteriorates operation efficiency.

SUMMARY OF THE INVENTION

An object of the present invention is to provide a tightening machine having a socket unit, even if a phase misalignment occurs between a nut and a reaction washer, capable of easily fitting an outer socket to a reaction washer in a state where the nut is fitted to an inner socket.

To solve the above problem, the present invention provides a tightening machine having a socket unit for tightening a reaction washer fitted to a bolt which projects from a structure, the socket unit including an inner socket whose tip end can engage with the nut, and an outer socket which is formed concentrically with the inner socket and whose tip end can engage with the reaction washer, the tightening machine concentrically including an inner socket holder and an outer socket holder which can rotate in opposite directions from each other, the outer socket holder being formed on an outer periphery of the inner socket holder, the inner socket being detachably engaged with the inner socket holder, and the outer socket being detachably engaged with the outer socket holder, wherein the inner socket is engaged with the inner socket holder with clearance in its circumferential direction.

According to the tightening machine having the socket unit of the present invention, the inner socket has clearance in the rotation direction with respect to the inner socket holder. Hence, the tightening machine is not influenced by a phase misalignment between the reaction washer and the nut, and if an operator rotates the tightening machine itself around its axis in a state where the nut is engaged with the inner socket, the inner socket can be rotated with respect to the outer socket and the phase of the outer socket with respect to the inner socket can be shifted. Therefore, the phases of the reaction washer and the outer socket can align with each other, and the outer socket can be engaged with the reaction washer.

Hence, the inching operation for operating the tightening machine and aligning the phases of the reaction washer and the outer socket with each other becomes unnecessary. Therefore, it is possible to remarkably enhance the efficiency of the final tightening operation.

BRIEF DESCRIPTION OF THE DRAWINGS

FIGS. 16A and 16B are diagrams of FIG. 15 as viewed from the nut, wherein FIG. 16A shows a state where phases of the nut and the reaction washer are the same and FIG. 16B shows a state where the phases of the nut and the reaction washer are different from each other.

DETAILED DESCRIPTION OF THE PREFERRED EMBODIMENTS

Figure 1:
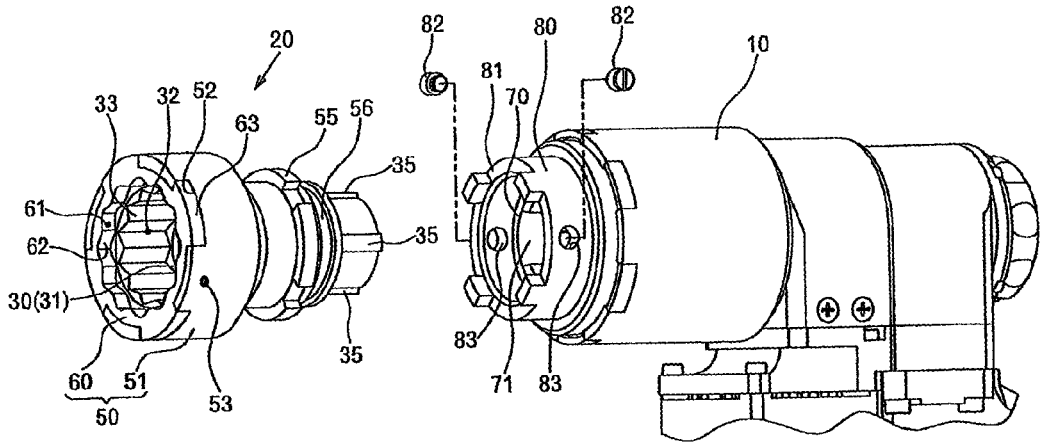
FIG. 1 is a perspective view showing a state where a socket unit is detached from a tightening machine.
Figure 15:
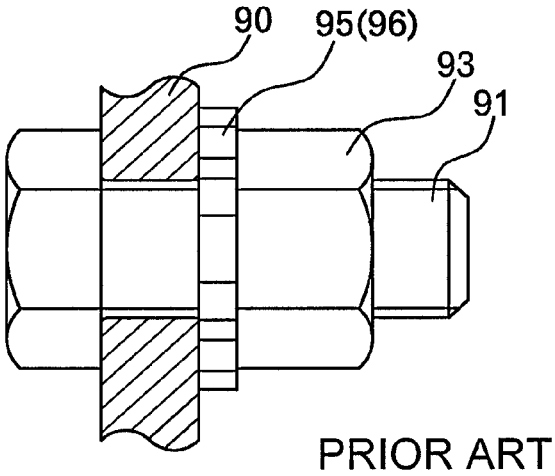
FIG. 15 is a sectional view showing a state where a reaction washer and a nut are fitted to a bolt projecting from a structure.

FIG. 1 is a perspective view showing a state where a socket unit 20 is detached from a tightening machine 10. The socket unit 20 is mounted on a tip end of the tightening machine 10 and as shown in FIG. 15, the socket unit 20 is for carrying out a final tightening operation of a nut 93 which is primary tightened to a bolt 91 projecting from a structure 90 through a reaction washer 95. A configuration of the socket unit 20 and a configuration of the tightening machine 10 will be described hereinafter.

<Socket Unit>

Figure 2:
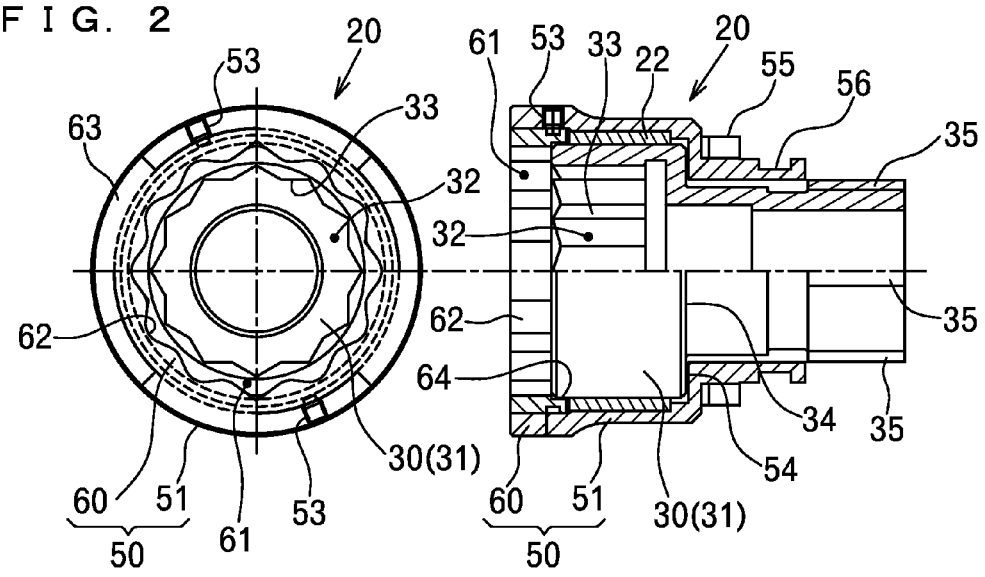
FIG. 2 is a front view and a partial sectional view of a side surface of the socket unit.
Figure 3:
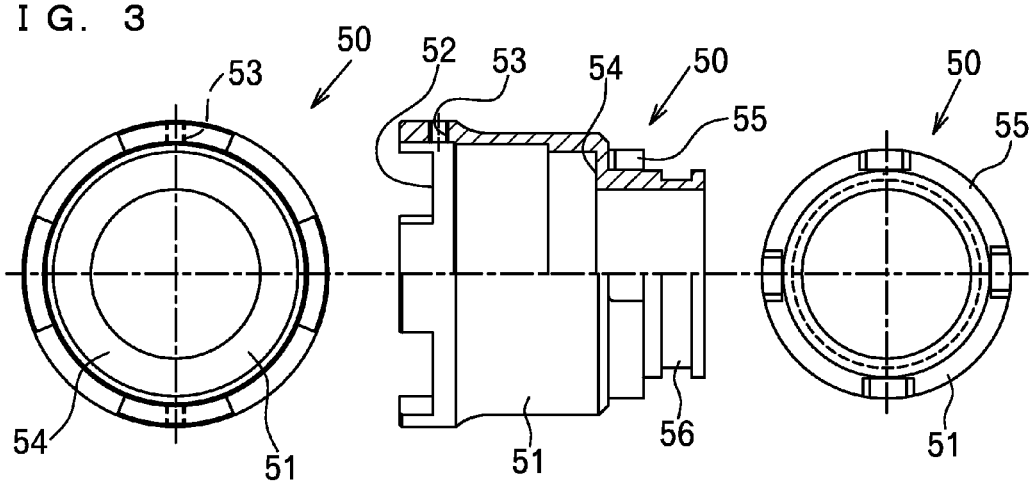
FIG. 3 is a front view, a partial sectional view of a side surface and a rear view of an outer socket body from which a reaction washer-engaging portion is detached.
Figure 4:
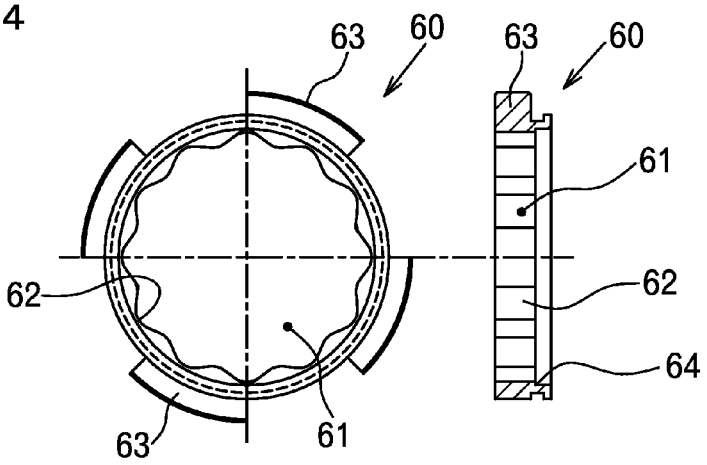
FIG. 4 is a sectional view and a front view of the reaction washer-engaging portion of a outer socket.

As shown in FIGS. 1 and 2, the socket unit 20 concentrically has an inner socket 30 disposed on its inner peripheral side and an outer socket 50 disposed on its outer peripheral side, a bush 22 is fitted between the inner socket 30 and the outer socket 50, and the inner socket 30 can rotate with respect to the outer socket 50.

As shown in FIGS. 1 to 4, the outer socket 50 includes a cylindrical outer socket body 51 which penetrates and opens in its axial direction, and a reaction washer-engaging portion 60 mounted on the outer socket body 51.

The outer socket body 51 includes a plurality of mounting recesses 52 (see FIG. 3) formed in its side (hereinafter referred to as "tip end" or "tip end side") opposite from the tightening machine 10, and the mounting recesses 52 mesh with a plurality of mounting projections 63 (see FIG. 4) projecting from an outer periphery of the reaction washer-engaging portion 60 at equally-spaced intervals. A screw hole 53 is formed in a peripheral surface of the outer socket body 51 near its tip end for integrally fixing the reaction washer-engaging portion 60.

A diameter of the outer socket body 51 on the side of the tightening machine 10 (hereinafter referred to as "base end" or "base end side") is reduced, and the inner socket 30 rotatably and slidably abuts against a support surface 54 whose diameter is reduced and which is perpendicular to the axial direction.

A mounting flange 55 having a plurality of notches projects from a diameter-reduced side peripheral surface of the outer socket body 51, the mounting flange 55 meshes with a flange receiving portion 81 of an outer socket holder 80, and the mounting flange 55 functions as a detent member when the outer socket 50 is mounted on the outer socket holder 80. A peripheral groove 56 into which a lock screw 82 is fitted is formed at a location closer to the base end side than the mounting flange 55, and the lock screw 82 functions as a detent member when the mounting flange 55 is mounted on the outer socket holder 80.

The reaction washer-engaging portion 60 is mounted on a tip end of the outer socket body 51, and includes a reaction washer-engaging hole 61 having an inner periphery into which a concavo-convex periphery 96 of an outer periphery of the reaction washer 95 is fitted. When the reaction washer 95 has twelve V-shaped concavo-convex peripheries 96, twelve V-shaped bottom grooves 62 are arranged in the reaction washer-engaging hole 61 at equally-spaced intervals in the circumferential direction.

A mounting projection 63 which is fitted into the mounting recess 52 of the outer socket body 51 projects from an outer periphery of the reaction washer-engaging portion 60 as described above. Notches are formed in the illustrated mounting projection 63 at predetermined intervals, projections formed between the notches mesh with the mounting recess 52 of the outer socket body 51.

An inner diameter of the base end of the reaction washer-engaging portion 60 is greater than a diameter of the reaction washer-engaging hole 61, and a step formed by this configuration functions as a later-described detent member 64 of the inner socket 30.

Figure 5:
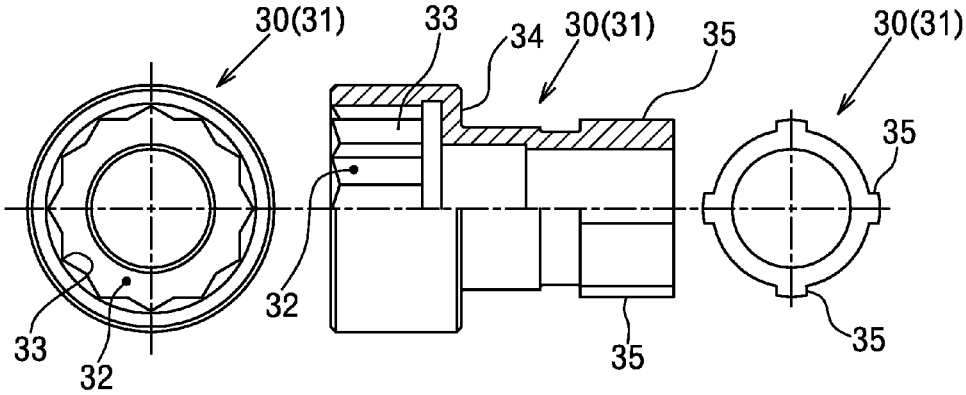
FIG. 5 is a front view, a partial sectional view of a side surface and a rear view of the inner socket.

As shown in FIGS. 1, 2 and 5, the inner socket 30 is configured based on a cylindrical inner socket body 31 which penetrates and opens in its axial direction, and the inner socket body 31 includes a nut-engaging hole 32. A diameter of a tip end of the nut-engaging hole 32 is increased, and the nut 93 is integrally rotatably engaged with an inner surface of the nut-engaging hole 32. The illustrated nut-engaging hole 32 has twelve V-shaped bottom grooves 33 at equally-spaced intervals in the circumferential direction so that the nut-engaging hole 32 can engage even if the grooves 33 are misaligned from the hexagonal nut 93 in phase 30°.

A diameter of the inner socket 30 at a location closer to its base end than the nut-engaging hole 32 is reduced, and its step 34 slidably abuts against the support surface 54 of the outer socket body 51.

A base end side of the inner socket body 31 projects more than a base end of the outer socket body 51 when the inner socket body 31 is mounted on the outer socket 50, a plurality of projections 35 project from a projecting peripheral surface in a direction along its axis, and the projections 35 engage with recesses 71 of a later-described inner socket holder 70 with clearance.

Widths of the projections 35 and the recesses 71 can appropriately be set in accordance with an amount of clearance required by the inner socket 30 with respect to the inner socket holder 70. It is preferable that the clearance has an angle exceeding 30° and in this case, it should be configured such that the projection 35 can rotate within the recess 71 beyond 30° in the circumferential direction. It is preferable that the clearance is set in a range of 35° or more and 45° or less, and more preferably 40° or more. By setting the clearance in this manner, the number of the phase alignment points of the reaction washer 95 matches with the phase of the outer socket 50 can be set to one or two.

In the illustrated embodiment, the number of the projections 35 is four, but if there is a margin of strength, the number of the projections 35 may be two or three. It is of course possible to provide five or more projections 35 depending upon a required amount of clearance.

In this embodiment, the projections 35 are formed on the inner socket 30 and the recesses 71 are formed in the inner socket holder 70, the projections 35 and the recesses 71 are nominal names in terms of description and the recesses may be formed in the inner socket 30 and the projections may be formed on the inner socket holder 70. The clearance is not limited to the engagement between the projection and the recess, and other configuration can also be employed.

The inner socket 30 having the above-described configuration is fitted into the outer socket body 51 with the bush 22 interposed therebetween, the mounting projections 63 of the reaction washer-engaging portion 60 is meshed with the mounting recess 52 of the outer socket body 51 and they are screwed, and the socket unit 20 shown in FIGS. 1 and 2 can be formed.

<Tightening Machine>

Figure 6:
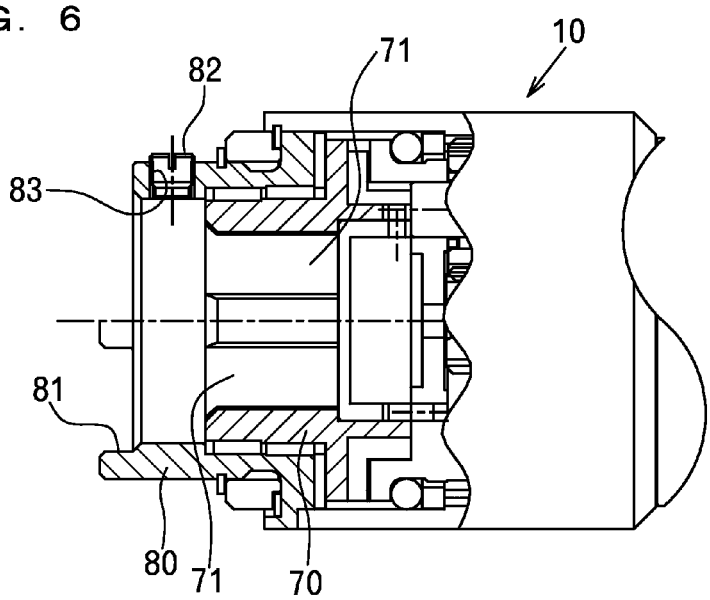
FIG. 6 is a partial sectional view of a side surface of a tip end of the tightening machine.
Figure 7:
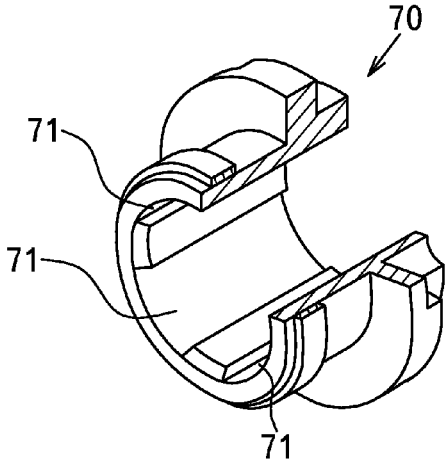
FIG. 7 is a partial sectional perspective view of an inner socket holder.
Figure 8:
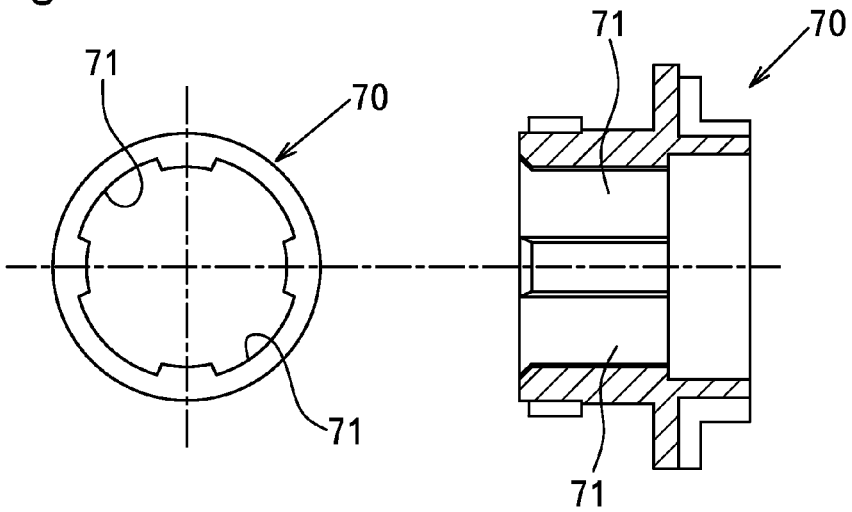
FIG. 8 is a front view and a sectional view of the inner socket holder.

As shown in FIGS. 1 and 6, the tightening machine 10 on which the socket unit 20 is detachably mounted has the inner socket holder 70 disposed on the inner side of its tip end and the outer socket holder 80 formed concentrically with the outer periphery of the inner socket holder 70 such that the inner socket holder 70 and the outer socket holder 80 can rotate in the opposite directions from each other. The inner socket holder 70 and the outer socket holder 80 are closely connected to a power mechanism (not shown) of the tightening machine 10 through a planet gear speed reducing mechanism (not shown) and they can rotate.

The present invention is characterized in that the inner socket 30 of the socket unit 20 is engaged with the inner socket holder 70 of the tightening machine 10 with clearance. Description of a mechanism which rotates the inner socket holder 70 and the outer socket holder 80 in the opposite directions will not be given.

Figure 9:
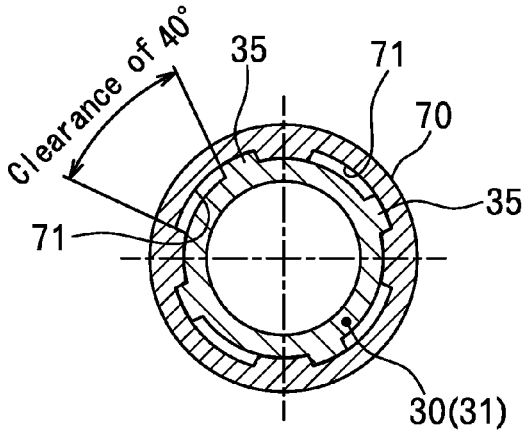
FIG. 9 is a sectional view showing an engaged state between the inner socket and the inner socket holder.

The inner socket holder 70 is the cylindrical holder which rotatably engages with the inner socket 30 of the socket unit 20 with clearance, is disposed at a location behind the outer socket holder 80, and as shown in FIGS. 1 and 6 to 8, the plurality of recesses 71, 71 are provided in the inner peripheral surface along the axial direction. When the inner socket 30 is fitted to the inner socket holder 70, the projection 35 of the inner socket 30 can engage with the recess 71 as shown in FIG. 9. The number of recesses 71 is the same as that of the projections 35 of the inner socket 30 and the number of the recesses 71 is four in the illustrated embodiment. A width of the recess 71 is formed wider than the projection 35 of the inner socket 30, and it is preferable that the width of the recess 71 is set such that the inner socket 30 can rotate by a desired amount of clearance with respect to the inner socket holder 70 in a state where the projection 35 is fitted to the recess 71. It is preferable that the angle of the clearance exceeds 30°, and the angle is preferably set in a range of 35° or more and 45° or less, and more preferably 40° or more as described above.

The outer socket holder 80 is a cylindrical holder disposed on the outer periphery of the inner socket holder 70 such that the outer socket holder 80 can rotate in the direction opposite from that of the inner socket holder 70, and the outer socket holder 80 is provided at its tip end with the flange receiving portion 81 including the plurality of notches with which the mounting flange 55 of the outer socket holder 80 meshes. Screw holes 83, 83 are formed in the outer socket holder 80 at locations close to its tip end. Lock screws 82 which enter peripheral grooves 56 of the base end of the outer socket 50 are fitted into the screw holes 83, 83 when the outer socket 50 is mounted.

The socket unit 20 is detachably mounted on the inner socket holder 70 and the outer socket holder 80 of the tightening machine 10. The socket unit 20 is fitted in a state where it is aligned such that the projections 35 of the tip end of the inner socket 30 are fitted to the recesses 71 of the inner periphery of the inner socket holder 70 (see FIG. 9) and then, the mounting flange 55 of the outer socket 50 is fitted to the flange receiving portion 81 of the outer socket holder 80, the lock screws 82 are tightened such that the socket unit 20 does not come out, and the socket unit 20 is mounted on the tightening machine 10.

Since the outer socket holder 80 and the inner socket holder 70 are closely connected to the power mechanism of the tightening machine 10, free rotation is prevented. Therefore, if the socket unit 20 is mounted on the tightening machine 10, the outer socket 50 and the outer socket holder 80 become one piece and they cannot be rotated. On the other hand, the inner socket 30 can rotate with respect to the outer socket 50 and the inner socket 30 has clearance in the rotation direction with respect to the inner socket holder 70. Therefore, the inner socket 30 can rotate within a range of clearance.

In the tightening machine 10 having the socket unit 20, the primary tightened nut 93 is finally tightened under predetermined torque. The final tightening operation is carried out in such a manner that the axis of the bolt 91 and the axis of the socket unit 20 are aligned with each other, the tightening machine 10 is moved forward such that the socket unit 20 approaches the nut 93 and the reaction washer 95 and in this state, the nut 93 is engaged with the nut-engaging hole 32 of the inner socket 30.

If the phases of the nut 93 and the groove 33 of the nut-engaging hole 32 are misaligned with each other, an operator rotates the tightening machine itself around its axis. In this embodiment, since the nut-engaging hole 32 has the twelve grooves 33 as shown in FIG. 5, if the operator rotates the tightening machine itself 30° at a maximum around its axis, the nut-engaging hole 32 and the nut 93 are engaged with each other.

Figure 16:
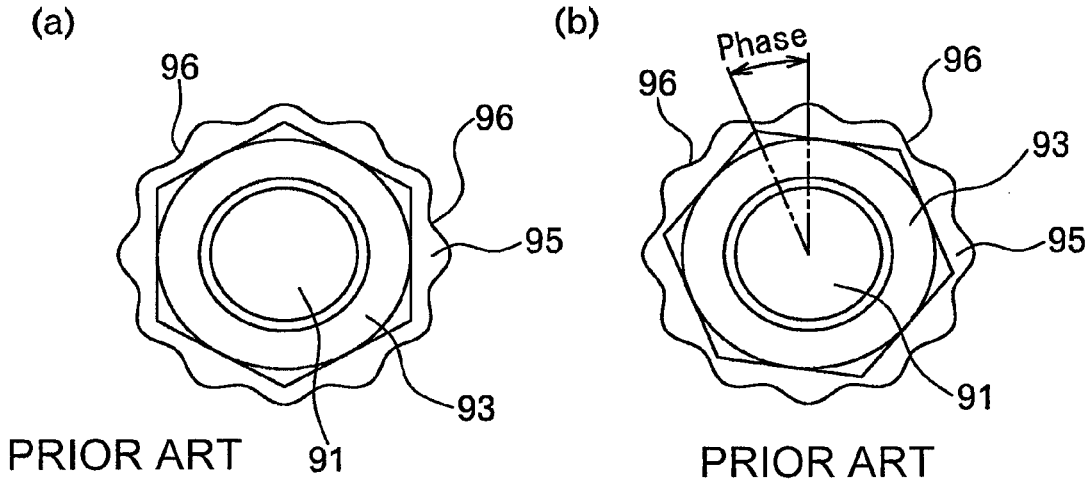

The tightening machine 10 is further moved forward in the state where the inner socket 30 and the nut 93 are engaged with each other, and the outer socket 50 and the reaction washer 95 are engaged with each other. At that time, if the concavo-convex periphery 96 of the reaction washer 95 and the grooves 62 of the outer socket 50 are not misaligned in phase from each other, the outer socket 50 can be engaged with the reaction washer 95 by moving the tightening machine 10 forward as it is. However, if the nut 93 and the reaction washer 95 have phase misalignment generated at the time of primary tightening as shown in FIG. 16B or if the inner socket 30 and the outer socket 50 are misaligned each other in phase, the outer socket 50 cannot excellently be engaged with the reaction washer 95.

In the present invention, since the inner socket 30 has clearance exceeding 30° in the rotation direction with respect to the inner socket holder 70, if an operator rotates the tightening machine itself around its axis in a state where the nut 93 is engaged with the inner socket 30, the inner socket 30 rotates with respect to the outer socket 50 and the phase of the outer socket 50 with respect to the inner socket 30 is shifted. Therefore, the phase of the concavo-convex periphery 96 of the reaction washer 95 and the phase of the groove 62 of the reaction washer-engaging hole 61 of the outer socket 50 can align with each other and the outer socket 50 can be engaged with the reaction washer 95. Further, if the clearance is 30°, the number of the phase alignment point becomes one or less, but if the clearance is set to the angle exceeding 30°, the number of the phase alignment points become one or two, and it becomes easy to engage the reaction washer 95 with the outer socket 50.

Therefore, the inching operation for operating the tightening machine 10 and making the phases of the reaction washer 95 and the outer socket 50 align with each other becomes unnecessary. Hence, it is possible to remarkably enhance the efficiency of the final tightening operation.

The nut-engaging hole 32 of the inner socket 30 has the twelve grooves 33, but the number of the grooves 33 can be six or eighteen.

Figure 10:
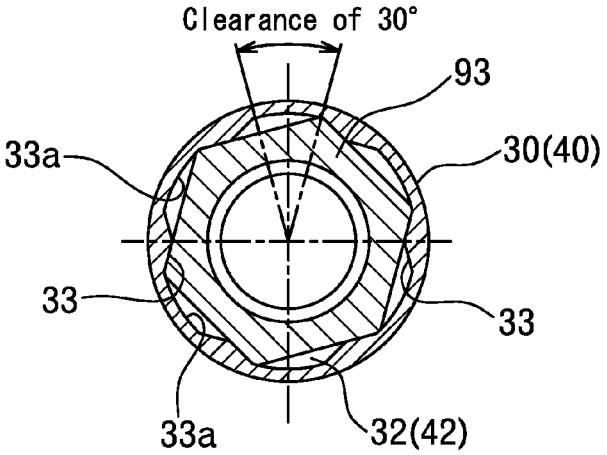
FIG. 10 is a sectional view showing an engaged state between the inner socket and the nut.

Concerning the nut-engaging hole 32 of the inner socket 30, if the bottom surfaces 33*a* of the grooves 33 with which the nut 93 engages are made as six groove-shapes each having a width in the circumferential direction as shown in FIG. 10, a total of clearance of the nut 93 with respect to the nut-engaging hole 32 and clearance between the inner socket 30 and the inner socket holder 70 in the circumferential direction can be set to an angle exceeding 30°. It is preferable that the total of clearance is 35° or more and 45° or less and more preferably 40° or more. When the total of clearance is set to 40°, if the clearance between the nut-engaging hole 32 and the nut 93 is 30°, the clearance between the inner socket 30 and the inner socket holder 70 should be set to 10°.

Another Embodiment

FIGS. 11 to 14 show different embodiments of the present invention. In the above embodiment, clearance is provided between the inner socket 30 and the inner socket holder 70 so that the inner socket 30 can turn with respect to the inner socket holder 70, but in the present embodiment, the inner socket 30 is divided into two members, i.e., a nut-side member 40 and a holder-side member 45, clearance is provided between the nut-side member 40 and the holder-side member 45, and the nut-side member 40 can turn with respect to the holder-side member 45. Since the outer socket 50 is the same as that of the above embodiment, explanation thereof will not be given.

Figure 11:
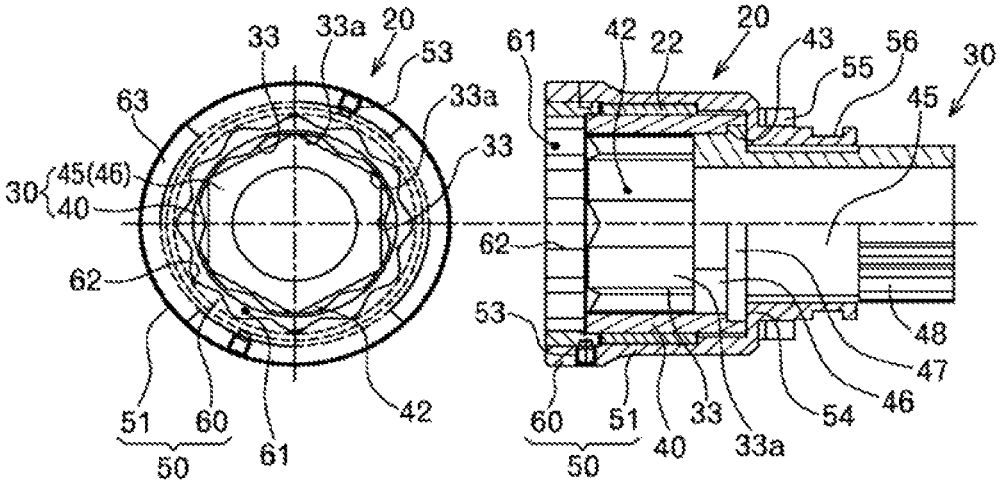
FIG. 11 shows another embodiment of the present invention, and is a front view and a partial sectional view of a side surface of a socket unit.

As shown in FIG. 11, the inner socket 30 includes the tip end nut-side member 40 and the base end holder-side member 45, and the inner socket 30 is accommodated in the outer socket 50.

Figure 12:
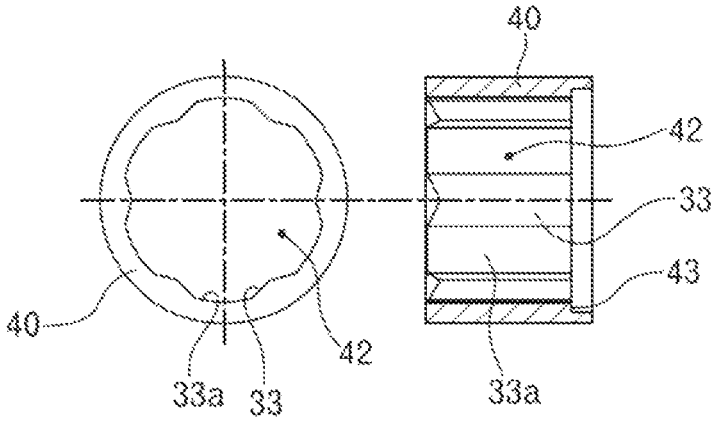
FIG. 12 is a front view and a sectional view of a side surface of a nut-side member.

An engaging hole 42 is formed in the nut-side member 40 over substantially the entire length in its axial direction to penetrate the nut-side member 40 where a nut 93 and the holder-side member 45 can engage with the engaging hole 42. The engaging hole 42 is provided at its inner periphery with grooves 33 with which the nut 93 and the holder-side member 45 can engage, each of the grooves 33 has a width in the circumferential direction of the bottom surface 33*a* as shown in FIG. 12, and the nut 93 and the holder-side member 45 can be fitted to the grooves 33 with clearance in the circumferential direction (see FIG. 10 of the above embodiment).

In the illustrated embodiment, each of the groove bottom surfaces 33*a* has the width of about 30°, and the nut 93 and the holder-side member 45 can be fitted into the engaging hole 42 with clearance of about 30° each.

A diameter of an inner periphery of the base end of the nut-side member 40 is increased, and forms a receiving portion 43 for the holder-side member 45 which will be described next.

Figure 13:
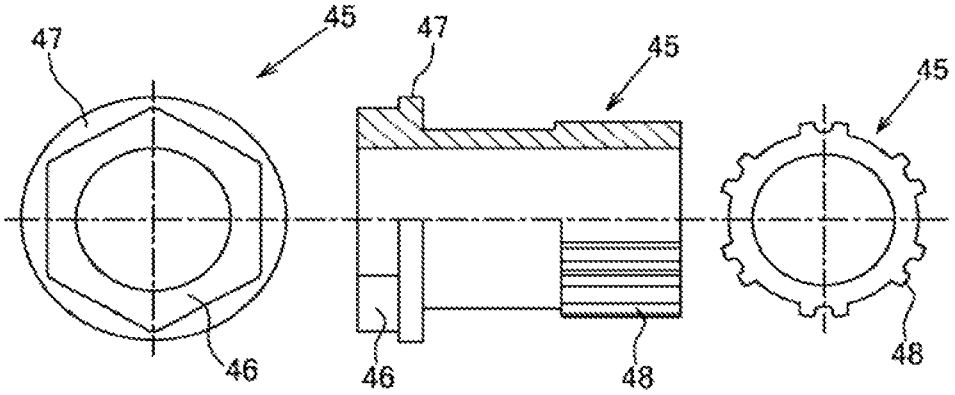
FIG. 13 is a front view, a sectional view of a side surface and a rear view of a holder-side member.
Figure 14:
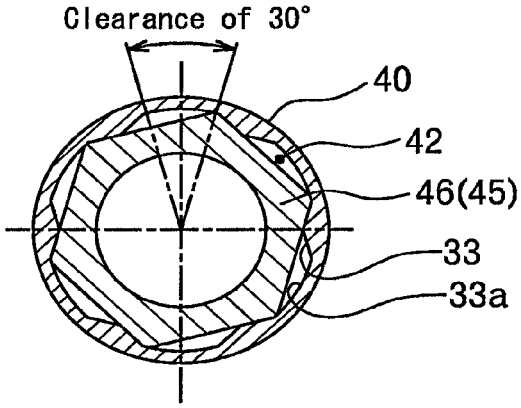
FIG. 14 is a sectional view showing an engaged state between the holder-side member and the nut-side member.

As shown in FIGS. 11 and 13, the holder-side member 45 is provided at its tip end with a hexagonal fitting member 46 which is substantially the same shape as that of the nut 93 to be tightened. As shown in FIGS. 11 and 14, the fitting member 46 is fitted into the engaging hole 42 of the nut-side member 40.

A diameter of a base end of the fitting member 46 is increased, and this configures a projection 47 which is turnably fitted into the receiving portion 43 of the nut-side member 40. A plurality of mounting projections 48 project in a direction along the axial direction from a side closer to the base end than the projection 47. The mounting projections 48 engaged with a mounting recess (not shown) formed in the inner socket holder 70 without clearance, and the mounting projections 48 rotate to follow the inner socket holder 70.

The fitting member 46 is fitted into the engaging hole 42 of the nut-side member 40, the holder-side member 45 is accommodated in the outer socket body 51, and the holder-side member 45 cannot come out due to the reaction washer-engaging portion 60 of the outer socket 50.

Concerning the socket unit 20 of the above configuration, since the fitting member 46 of the holder-side member 45 and the engaging hole 42 of the nut-side member 40 are engaged with each other with clearance as shown in FIG. 14, the nut-side member 40 can turn by the amount of clearance with respect to the holder-side member 45. In this embodiment, the clearance between the holder-side member 45 and the nut-side member 40 is about 30°. The engaging hole 42 of the nut-side member 40 can also engage with the nut 93 with clearance. Therefore, the nut 93 can be fitted into the engaging hole 42 with clearance in the circumferential direction. In this embodiment, the clearance between the nut-side member 40 and the nut 93 is about 30°.

Therefore, the nut 93 has clearance of two times of the above clearance, i.e., clearance of about 60° in this embodiment with respect to the holder-side member 45 which is non-turnably mounted on the inner socket holder 70.

In the tightening machine 10 having the socket unit 20, the primary tightened nut 93 is finally tightened under predetermined torque. The final tightening operation is carried out in such a manner that an axis of the bolt 91 and an axis of the socket unit 20 are made to align with each other, the tightening machine 10 is moved forward such that the socket unit 20 approaches the nut 93 and the reaction washer 95 and in this state, the nut 93 is engaged with the engaging hole 42 of the inner socket 30.

If the phases of the nut 93 and the groove 33 of the nut-engaging hole 32 are misaligned with each other, an operator rotates the tightening machine itself around its axis. In this embodiment, since the groove 33 of the engaging hole 42 has the bottom surface 33*a* of about 30° as shown in FIG. 10, if the operator rotates the tightening machine itself around its axis 30° at the maximum, the engaging hole 42 and the nut 93 engage with each other.

The tightening machine 10 is further moved forward in the state where the inner socket 30 and the nut 93 are engaged with each other, and the outer socket 50 and the reaction washer 95 are engaged with each other. At that time, if the concavo-convex periphery 96 of the reaction washer 95 and the grooves 62 of the outer socket 50 are not misaligned in phase from each other, the outer socket 50 can be engaged with the reaction washer 95 by moving the tightening machine 10 forward as it is. However, if the nut 93 and the reaction washer 95 have phase misalignment generated at the time of primary tightening as shown in FIG. 16B or if the inner socket 30 and the outer socket 50 are misaligned in phase, the outer socket 50 cannot excellently be engaged with the reaction washer 95.

According to the inner socket 30 of the present invention, the nut-side member 40 has the clearance in the circumferential direction with respect to the holder-side member 45, and the nut 93 has the clearance in the circumferential direction with respect to the nut-side member 40. Therefore, if an operator rotates the tightening machine itself around its axis in the state where the nut 93 is engaged with the inner socket 30, the nut-side member 40 rotates with respect to the holder-side member 45 and the nut 93 rotates with respect to the nut-side member 40. Hence, the phase of the outer socket 50 with respect to the nut 93 can be shifted, the phase of the concavo-convex periphery 96 of the reaction washer 95 and the phase of the groove 62 of the reaction washer-engaging hole 61 of the outer socket 50 can be made to align with each other, and the outer socket 50 can be engaged with the reaction washer 95.

Therefore, the inching operation for operating the tightening machine 10 and making the phases of the reaction washer 95 and the outer socket 50 align with each other becomes unnecessary. Hence, it is possible to remarkably enhance the efficiency of the final tightening operation.

In the above embodiment, the clearance between the nut-side member 40, the holder-side member 45 and the nut 93 is set to about 30° (total about 60°). However, the total clearance is not limited to this, and it is preferable that the clearance is set to an angle exceeding 30°, more preferably 35° or more and 45° or less, and more preferably 40° or more.

The present invention is effective as a tightening machine having a socket unit capable of easily fitting an outer socket to a reaction washer in a state where a nut is fitted to an inner socket even if phases of the nut and the reaction washer are misaligned each other.

What is claimed is:

1. A tightening machine comprising:

a socket unit for tightening a reaction washer and a nut fitted to a bolt which projects from a structure, the socket unit including an inner socket comprising a tip end engageable with the nut, and an outer socket formed concentrically with the inner socket and comprising a tip end engageable with the reaction washer, the tightening machine comprises an inner socket holder and an outer socket holder configured to rotate in opposite directions from each other, the outer socket holder formed on an outer periphery of the inner socket holder, the inner socket detachably engageable with the inner socket holder, and the outer socket detachably engageable with the outer socket holder, wherein the inner socket comprises a nut-side member engageable with the nut and a holder-side member engageable with the inner socket holder, the nut-side member comprises a nut-engaging hole comprising six grooves at equally-spaced intervals in the circumferential direction, a bottom surface of each of the grooves has a width in the circumferential direction, and the bottom surface has clearance in the circumferential direction with respect to the nut, the holder-side member comprises at its tip end a hexagonal fitting member substantially the same shape as that of the nut, and the hexagonal fitting member is fitted into the engaging hole of the nut-side member with clearance in the circumferential direction.

2. The tightening machine having the socket unit according to claim 1, wherein the bottom surface of each of the grooves has the width of about 30°.

* * * * *